US011199020B2

(12) United States Patent
Gendel

(10) Patent No.: US 11,199,020 B2
(45) Date of Patent: Dec. 14, 2021

(54) STRUCTURES AND METHODS OF ERECTING THE SAME

(71) Applicant: Morgan Gendel, Washington, DC (US)

(72) Inventor: Morgan Gendel, Washington, DC (US)

( * ) Notice: Subject to any disclaimer, the term of this patent is extended or adjusted under 35 U.S.C. 154(b) by 0 days.

(21) Appl. No.: 16/750,212

(22) Filed: Jan. 23, 2020

(65) Prior Publication Data

US 2020/0181937 A1 Jun. 11, 2020

Related U.S. Application Data

(63) Continuation-in-part of application No. PCT/US2018/047275, filed on Aug. 21, 2018.

(60) Provisional application No. 62/548,566, filed on Aug. 22, 2017.

(51) Int. Cl.

| | |
|---|---|
| ***E04B 1/34*** | (2006.01) |
| ***E04H 15/20*** | (2006.01) |
| ***A47C 4/54*** | (2006.01) |
| ***E04B 1/343*** | (2006.01) |
| ***E04H 1/12*** | (2006.01) |
| ***F41H 5/24*** | (2006.01) |

(52) U.S. Cl.

CPC ..... *E04H 15/20* (2013.01); *A47C 4/54* (2013.01); *E04B 1/343* (2013.01); *E04H 1/1205* (2013.01); *F41H 5/24* (2013.01); *E04H 2015/201* (2013.01)

(58) Field of Classification Search

CPC ..... E04H 2015/206; E04H 2015/204; E04H 1/1277; E04H 2015/201; E04H 15/20

USPC ..... 52/2.18, 741.1, 2.11, 2.23; 427/238

See application file for complete search history.

(56) References Cited

U.S. PATENT DOCUMENTS

| | | | | |
|---|---|---|---|---|
| 5,140,768 | A * | 8/1992 | Forbes | E04B 1/0046 47/17 |
| 5,142,717 | A * | 9/1992 | Everard | A47C 27/083 5/709 |
| 5,319,904 | A | 6/1994 | Pascoe | |
| 6,266,926 | B1 * | 7/2001 | Figge | E04H 9/04 102/303 |
| 7,464,506 | B2 * | 12/2008 | Atkinson | E04H 9/14 52/202 |
| 8,572,911 | B1 * | 11/2013 | Binienda | E04H 15/20 52/202 |

(Continued)

FOREIGN PATENT DOCUMENTS

| | | | |
|---|---|---|---|
| DE | 202015005990 | U1 | 11/2015 |
| WO | WO2015006613 | A1 | 1/2015 |
| WO | WO2015123128 | A1 | 8/2015 |

OTHER PUBLICATIONS

International Search Report and Written Opinion, International Patent Application No. PCT/US2018/047275, dated Nov. 2, 2018.

(Continued)

*Primary Examiner* — Chi Q Nguyen

(74) *Attorney, Agent, or Firm* — Saul Ewing Arnstein & Lehr LLP; Gianna Julian Arnold; Brian R. Landry

(57) ABSTRACT

A structure that includes strut tubes that receive and hold within them a granular material—soil, sand, gravel, regolith, or plastic pellets—to which compression is applied after loading. By this means the struts are stiffened to facilitate its use as a durable shelter. The structure is erected by inflating the strut tubes with a fluid which is then displaced with the granular material before compression is applied.

9 Claims, 14 Drawing Sheets

(56) References Cited

U.S. PATENT DOCUMENTS

| | | | | |
|---|---|---|---|---|
| 8,578,657 | B2 * | 11/2013 | Colucci | E04H 15/20 52/2.16 |
| 9,171,649 | B2 * | 10/2015 | Zeik | E04H 1/125 |
| 9,776,724 | B2 * | 10/2017 | Marappan | B60N 2/64 |
| 2002/0166293 | A1 * | 11/2002 | Zeik | A61N 5/10 52/79.1 |
| 2004/0247397 | A1 | 12/2004 | Fox | |
| 2011/0094421 | A1 | 4/2011 | Brock | |
| 2011/0203189 | A1 * | 8/2011 | Moran | E04H 1/1244 52/2.18 |
| 2012/0291362 | A1 * | 11/2012 | Milo | E04H 15/20 52/2.18 |
| 2014/0137484 | A1 * | 5/2014 | Purdy | E04C 2/296 52/2.15 |
| 2015/0040487 | A1 * | 2/2015 | Wiliams | B05B 16/40 52/2.23 |
| 2015/0073318 | A1 | 3/2015 | Holschuh et al. | |
| 2015/0101258 | A1 * | 4/2015 | Milo | E04B 1/3505 52/2.18 |
| 2015/0267425 | A1 * | 9/2015 | Harlow | E04H 1/1277 52/2.18 |
| 2016/0017562 | A1 | 1/2016 | Barron et al. | |
| 2016/0053921 | A1 * | 2/2016 | Haynes | E04G 15/066 52/2.11 |
| 2016/0340064 | A1 * | 11/2016 | Loda | B65B 1/16 |
| 2017/0096825 | A1 | 4/2017 | Bree | |
| 2019/0375572 | A1 * | 12/2019 | Nelson | B65D 88/72 |

OTHER PUBLICATIONS

Britt, R., "Star Trek Writer has a Great Idea for a C Habitat", https://www.inverse.com/article/36135-habolith-mars-air-struts-nasa-spa . . . , downloaded Jan. 10, 2020, 18 pages.

COMSOL, "Piezoelectric Effect Definition", https://www.comsol.com/multiphysics/piezoelectric-effect, downloaded Aug. 21, 2018, 8 pages.

NASA, "Human Exploration of Mars Design Reference Architecture 5.0", Jul. 2009, 100 pages.

War Office, "Field Engineering (All Arms), Military Training Pamphlet No. 30, Part V: Protective Works (Provisional)", 1941, 63 pages.

Wikipedia, "Earthbag construction", https://en.wikipedia.org/wiki/Earthbag_construction, downloaded Jan. 10, 2020, 9 pages.

Wikipedia, "Jamming (physics)", https://en.wikipedia.org/;wiki/Jamming_(physics), downloaded Aug. 16, 2018, 2 pages.

* cited by examiner

STRUCTURES AND METHODS OF ERECTING THE SAME

CROSS-REFERENCE TO RELATED APPLICATION(S)

This application is a continuation-in-part under 35 U.S.C. § 120 of International Application No. PCT/US2018/047275, filed Aug. 21, 2018, which claims the benefit of priority to U.S. Provisional Patent Application Ser. No. 62/548,566, filed Aug. 22, 2017. The entire content of this application is hereby incorporated by reference herein.

BACKGROUND OF THE INVENTION

Shelters are used in a variety of situations including emergencies, events, and temporary needs. Shelters are also needed for planetary exploration, e.g., planned trips to Mars.

In both situations, mass and volume are often at a premium to varying degrees, e.g., affecting payload capacity and fuel needs for aircraft and spacecraft.

SUMMARY OF THE INVENTION

One aspect of the invention provides a structure including one or more strut tubes adapted and configured to receive and hold a granular material. The one or more strut tubes further include compression means for applying at least compression to the granular material after loading.

This aspect of the invention can have a variety of embodiments. The structure can further include one or more sheathing pieces integrated with, coupled to, or couplable to the one or more strut tubes.

The one or more strut tubes can be flexible before loading.

The compression means can be selected from the group consisting of: tensioners, fasteners, shape-memory members, piezoelectric members, cross-linkers, press fittings, and a pressure differential.

The one or more strut tubes can be fabricated from a textile or flexible sheet. The one or more strut tubes can be fabricated from a high-tensile textile or flexible sheet. The textile can include one or more selected from the group consisting of: aramids, para-aramids, meta-aramids, and ceramic fibers.

The granular material can be selected from the group consisting of: soil, sand, gravel, rock, ash, regolith, plastic pellets, and wood chips.

Another aspect of the invention provides a method of erecting a structure. The method includes: inflating one or more strut tubes with a fluid; displacing the fluid with granular material; and compressing the granular material.

BRIEF DESCRIPTION OF THE DRAWINGS

For a fuller understanding of the nature and desired objects of the present invention, reference is made to the following detailed description taken in conjunction with the accompanying drawing figures wherein like reference characters denote corresponding parts throughout the several views.

DEFINITIONS

The instant invention is most clearly understood with reference to the following definitions.

As used herein, the singular form "a," "an," and "the" include plural references unless the context clearly dictates otherwise.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from context, all numerical values provided herein are modified by the term about.

As used in the specification and claims, the terms "comprises," "comprising," "containing," "having," and the like can have the meaning ascribed to them in U.S. patent law and can mean "includes," "including," and the like.

Unless specifically stated or obvious from context, the term "or," as used herein, is understood to be inclusive.

Ranges provided herein are understood to be shorthand for all of the values within the range. For example, a range of 1 to 50 is understood to include any number, combination of numbers, or sub-range from the group consisting 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50 (as well as fractions thereof unless the context clearly dictates otherwise).

DETAILED DESCRIPTION OF THE INVENTION

Embodiments of the invention are directed to structures including one or more strut tubes adapted and configured to hold a granular material. The strut tubes can apply compression to the granular material after loading. This compression can cause the granular materials to jam and become rigid. Although binders such as cement or gypsum could be utilized for added security, such binders are not necessary. In some embodiments, sheets, textiles, fabrics, and the like can be reinforced with one or more coatings, meshes, grids, honeycombs, and the like. Such reinforcements can be bound to the strut tube and or sheathing and/or can float within another structure (e.g., sitting within strut tube and engaging with granular material).

Embodiments of the invention are particularly advantageous over inflatable structures that maintains their shape via internal positive pressure. Such structures are subject to rapid deformation in the event of a puncture, e.g., caused by micrometeorites or wind-driven particles. In contrast, the present invention's independent, stiffened struts will not deform following a puncture (especially when soil jamming is facilitated by means other than vacuum), nor will the entire unit collapse if a large puncture allows breathable air to escape, even prior to soil jamming.

FIGS. 1A-1D illustrate one embodiment of the invention.

Figures 1A, 1B, 1C, 1D:
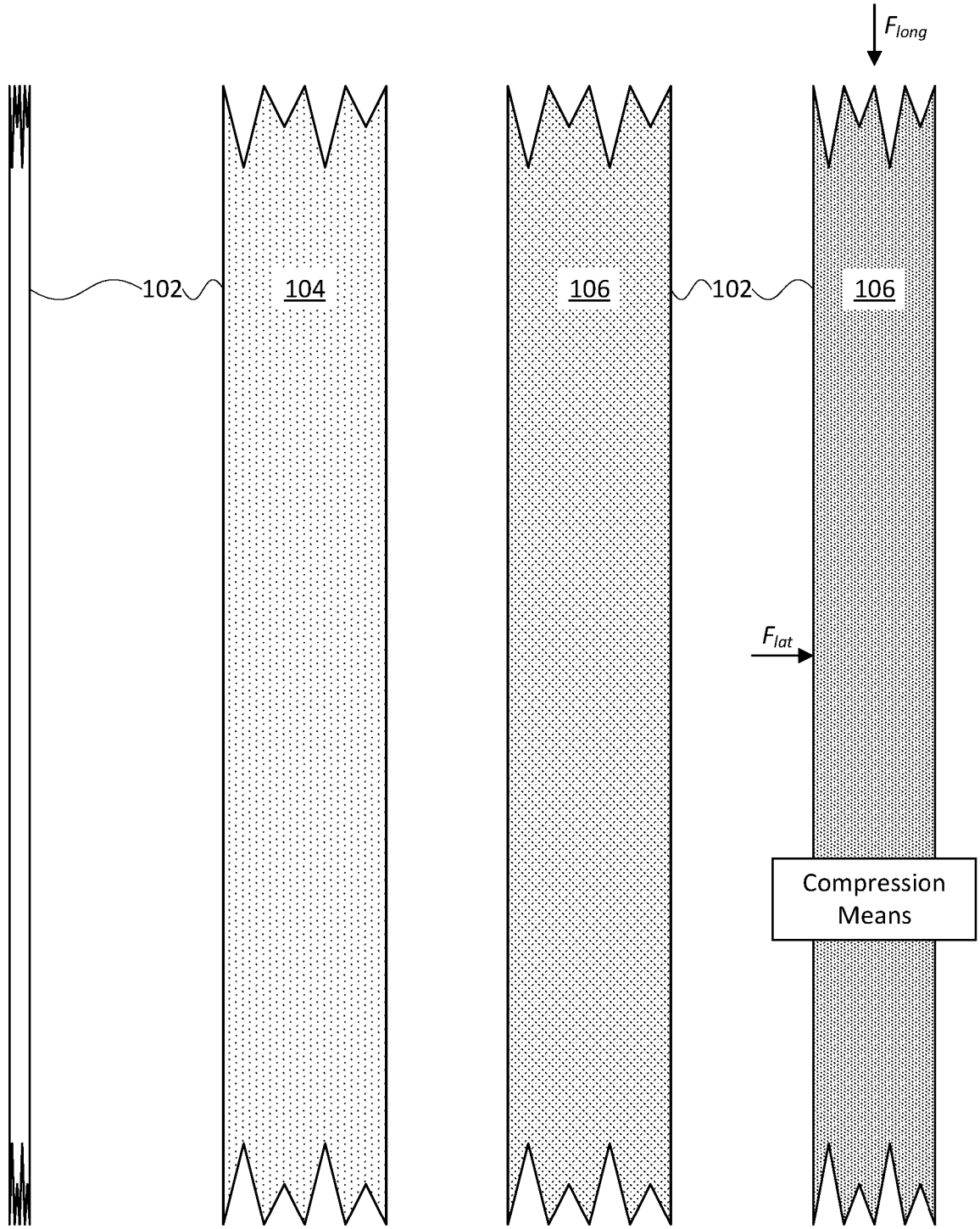
FIGS. 1A-1D depict the inflation, filling with granular material, and compression of granular material according to an embodiment of the invention.
Figure 2A:
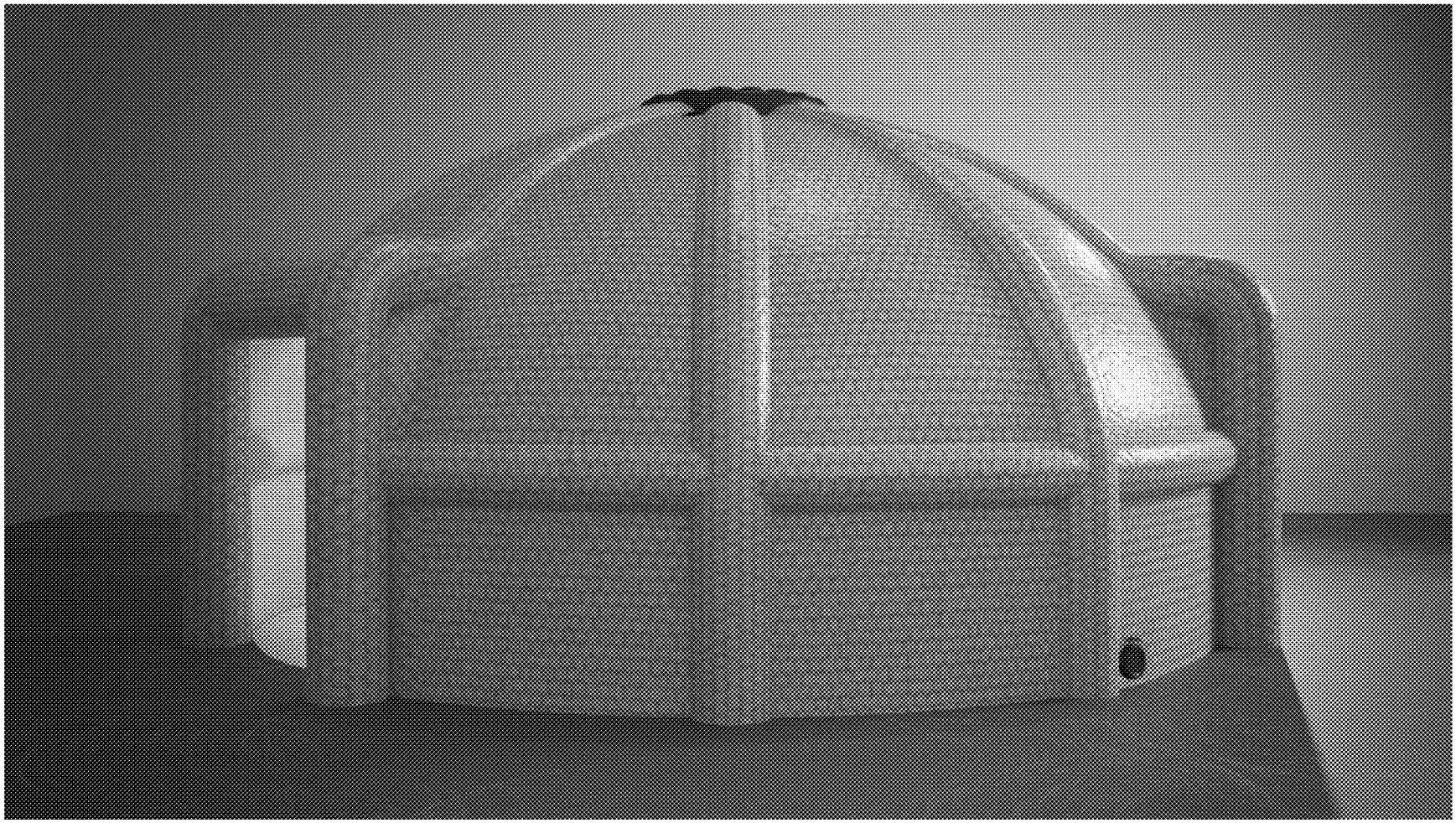
FIGS. 2A and 2B depict exterior side and perspective views of a structure including one or more strut tubes according to an embodiment of the invention. The structure includes two integrated door-shaped openings.
Figure 2B:
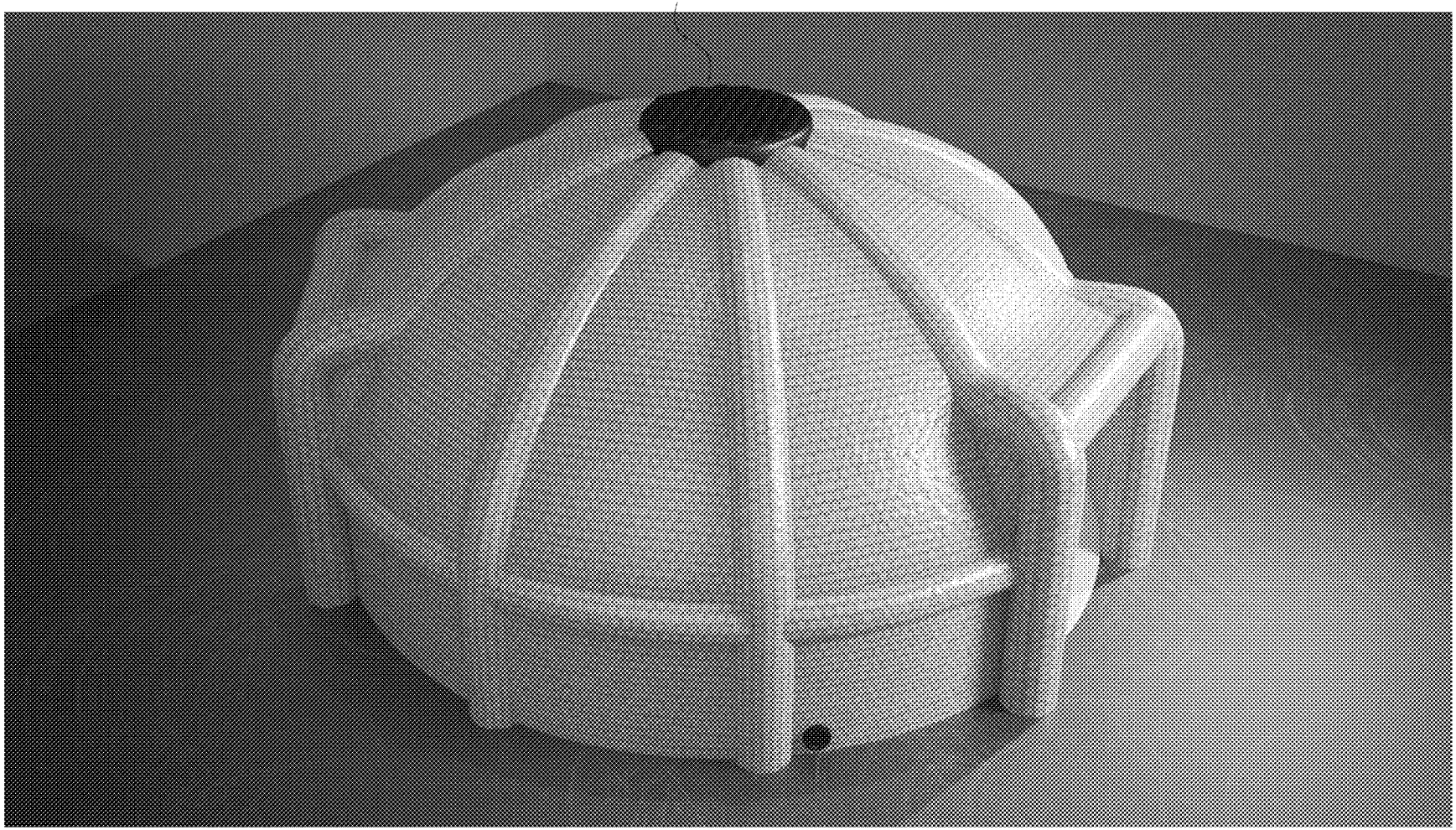

In FIG. 1A, a strut tube 102 is provided. Although depicted as having a uniform hollow interior for illustration, strut tube 102 can be a flexible material that collapses on itself in the absence of internal pressure. Likewise, one or more ends of strut tube 102 can be sealed or sealable. Although FIGS. 1A-1D depict a linear strut tube 102, strut tube 102 can have a variety of shapes including arcs, arches, crosses, wyes, circles, domes and the like, thereby enabling spacious structures.

In FIG. 1B, the strut tube can optionally be inflated with a fluid 104 such as a liquid or a gas. In one embodiment, an ambient gas such as air can be utilized in order to minimize material needs and costs.

In FIG. 1C, the fluid 104 is replaced (e.g., gradually) with a granular material 106. Granular material 106 can be added using a variety of tools including shovels, pump, vacuum, conveyor belt, and the like. In some embodiments, the granular material is entrained in an airstream provided in FIG. 1B, particularly when the strut tube is leaky or vented.

In FIG. 1D, the strut tube 102 compresses the granular material (reflected by the higher-density hatching). A variety of compression techniques are described herein. Advantageously, the assembled strut tube 102 can bear both longitudinal ($F_{long}$) and lateral ($F_{lat}$) compressive forces.

The strut tubes 102 can be made from a variety of materials and dimensions, which can be engineered to achieve desired physical properties (e.g., using calculated slenderness ratios). Exemplary cross-sectional widths include between 5 cm and 10 cm, between 10 cm and 20 cm, between 20 cm and 50 cm, between 50 cm and 100 cm, between 100 cm and 1 m, and greater than 1 m.

In one embodiment, the strut tubes 102 are made from a flexible material such as a textile or a flexible sheet that can be collapsed, rolled, folded, and the like for easy transport. In some embodiments, the struts and other components of the structure can be vacuum-sealed to minimize collapsed volume.

Struts can be completely or substantially air-tight. For example, the textile or flexible sheet can be inherently air-tight and/or the assembled strut can be sealed after assembly. Air sealing advantageously allows the strut to be inflated using air prior to displacement of air with granular materials. In either completely or substantially air-tight embodiments, a blower, gas tank, and the like can continue to blow air into the struts to compensate for leakage (e.g., during filling).

Struts can include one or more compression means for compressing the granular material after loading. A variety of compression means including mechanical, chemical, and electrical are contemplated with examples described herein.

In one embodiment, lacing is provided along the strut. The lacing (which can be any tensile material such as twine, rope, wires, cables, wires, and the like) can be wrapped annularly, helically, and the like around the strut. (Such arrangements can also be applied to the other compression means described herein.) As the lacing is tightened, the lacing and the underlying strut wall pulls inward, applying a compressive force to the granular material within. Lacing can be secured using one or more knots, camming devices, winches, come alongs, fasteners, and the like.

In another embodiment, one or more fasteners, e.g., mechanical fasteners are provided. For example, bolts, rivets, and the like can be arrayed along the fastener and tightened and/or drawn together (e.g., with the use of ratchets, impact drivers, presses, and the like) to draw the strut walls tighter.

In still other embodiments, the strut tube can be mechanically deformed. For example, the strut tube can include a plurality of externally projecting nubs (e.g., having hemispherical or cylindrical profiles) made of a substantially rigid material such as metal or plastic. After the strut tube is filled with a granular material (which would fill the inside of the nubs), the nubs could be pressed to protrude into the strut tube (e.g., with a mechanical press), thereby reducing the internal volume of the strut tube and compressing the granular material. Similarly, one or more annular members, either integral with or external to the strut tube, can be deformed, e.g., using a mechanical press similar to those used to seal pipes.

In still other embodiments, the strut tube can have shape memory. For example, the strut tube can include shape memory metal (e.g., Nitinol alloy) or a shape memory polymer that can elongate when warmed (e.g., with hot air from a blower inflating the strut tube prior to and during filling with the granular material), but return to a serpentine shape when cool, thereby constricting and compressing the granular material. In still another embodiment, the strut tube can include a material that returns to a desired shape upon actuation of energy (e.g., heat or electricity) as described in U.S. Patent Application Publication Nos. 2015/0073318, 2015/0073319, and 2017/0304136.

In still other embodiments, the strut tube can include one or more materials that contract when cross-linked, e.g., through heat, light, or chemical cross-linkers.

In still another embodiment, an internal vacuum can be drawn. For example, the strut tube 102 could include a check valve to allow a vacuum to be pulled and held.

In still another embodiment, electricity can be applied to a piezoelectric material to utilize the inverse piezoelectric effect to deform the piezoelectric material and compress the granular material.

In any embodiment, the compression means can engage with one or more reinforced regions of the strut wall such as grommets, bars, webbing, stitching, and the like.

Structures Incorporating Strut Tubes

The strut tubes described herein can be utilized in a variety of structures having varying architectures. Exemplary embodiments include shelters (e.g., for military encampments, use as emergency shelters for refugees, victims of natural disasters, or the homeless, and the like), storage buildings (e.g., hangars, Quonset huts, and the like). In some embodiments, the structures are designed for extraterrestrial use (e.g., on a planet such as Mars, on the moon, and the like). In some embodiments, the structure can be inhabited before filling with granular material, thereby allowing for quicker setup and disassembly for short emergencies while permitting a transition to a more durable structure for longer-lasting needs.

Structures utilizing the strut tubes can be integral such that the entire structure can be assembled by inflating and filling strut tubes. Alternatively, the strut tubes can be utilized as a frame over which a fly or other material is applied for shelter.

In some embodiments, internal furnishings such as cots, tables, desks, chairs and the like are integral to the structure and are inflated and/or filled with granular material in a turnkey manner during erection of the structure.

In some embodiments, the structure can include a floor and/or one or more air locks to maintain pressure within the structure sufficient to support human life in an extraterrestrial environment. The floor can be a polymer sheet or can be inflatable and fillable to provide additional ballast and/or insulation. Tubing/conduit for heating, cooling, plumbing, electricity, telephone, and/or data can also be integrated within or adjacent to the strut tubes or other structural elements. The granular material can advantageously provide thermal and other types of insulation. Thus, in some embodiments, the non-strut portions of roof and/or walls can include pockets to receive granular materials. In some embodiments, tubing in the roof (e.g., in panel 202) can be used to heat water during the day and/or to radiatively cool water at night.

One or more portions of the structure (e.g., the floor or furniture) can store water or other fluids, which also would provide ballast to the structure. Such an embodiment can be particularly useful in a disaster relief structure, as the water can be potable or usable for bathing. The water can also serve as a thermal ballast for temperature management.

Exemplary Materials

The components described herein can be fabricated from a variety materials. The materials can be in a variety of forms such as sheet (e.g., extruded), textile, fabric, and the like.

Exemplary materials include, but are not limited to: natural fibers, cotton, wool, silk, hemp, flax, animal hair, jute, modal, cellulose, bamboo, piña, ramie, nettles, milkweed, seaweed, metals, manufactured fibers, azlon, acetate, triacetate, viscose, lyocell, glass, graphite carbon, carbon fiber, carbon nanotube, liquid crystal, ceramics, polyesters, aramids, para-aramids, meta-aramids, aromatic polyesters, rayon, acrylics, modacrylics, polyacrylonitrile, polylactides (PLAs), polyamides, polyamide 6, polyamide 6.6, rubber lastrile, lastol, polyethylene (PE), high-density polyethylene (HDPE), polyethylene terephthalate (PET), polypropylene (PP), polytetrafluoroethylene (PTFE), vinyl, vinyon, vinylidene chloride, polyvinylidene chloride (PVDC), polybenzimidazole (PBI), novoloid, melamine, anidex, nytril, elastoester, nylon, spandex/elastane, olefins, biosynthetic polymers, and blends of the same.

Materials can be engineered to provide desired attributes such as resistance to radiation (e.g., ultraviolet and/or cosmic), puncture, temperatures, humidity, and the like.

Assembly

Figure 3A:
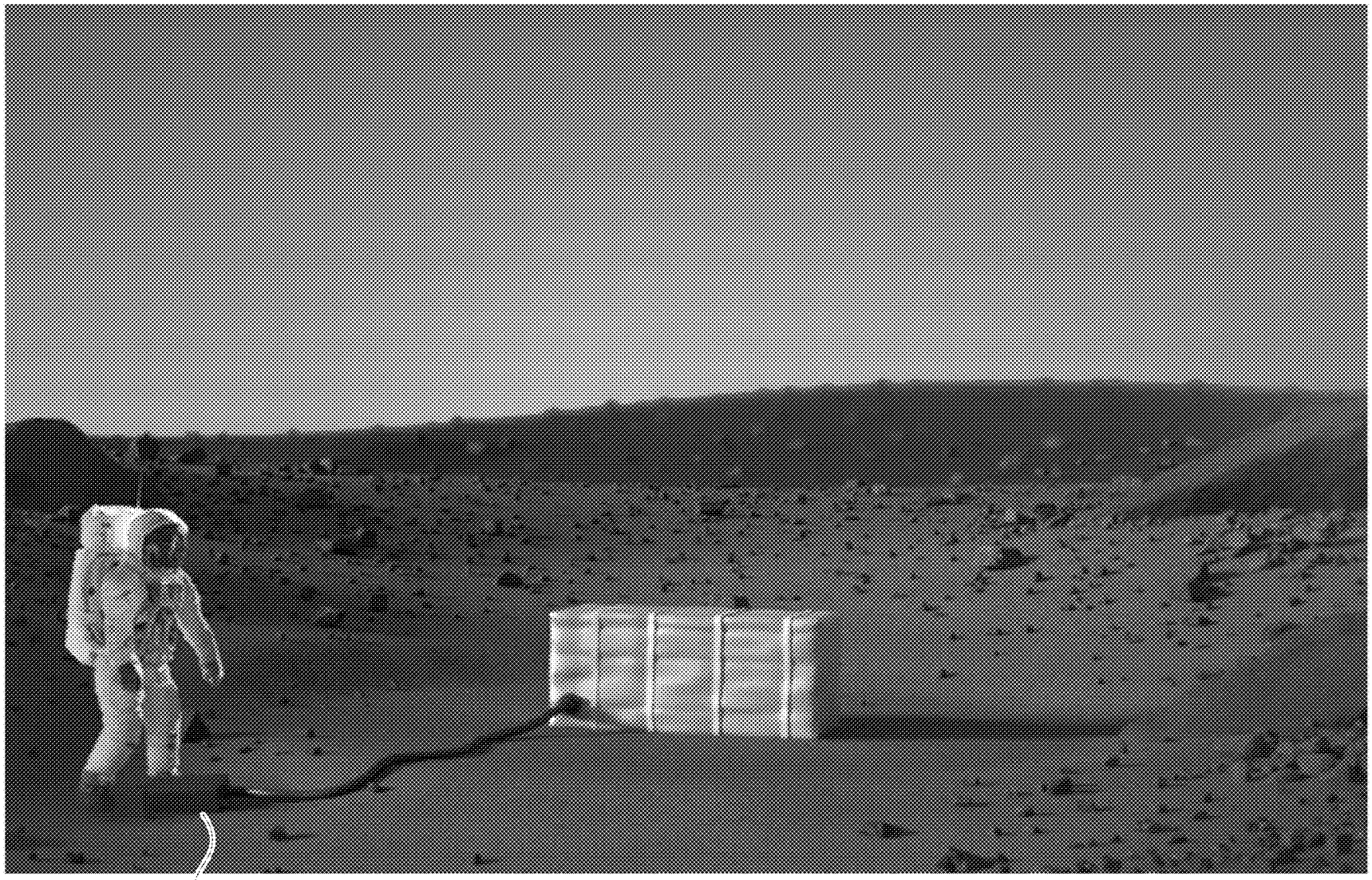
FIGS. 3A-3E depict a method of erection of a structure according to an embodiment of the invention using a small pump adjacent to an astronaut.
Figure 3B:
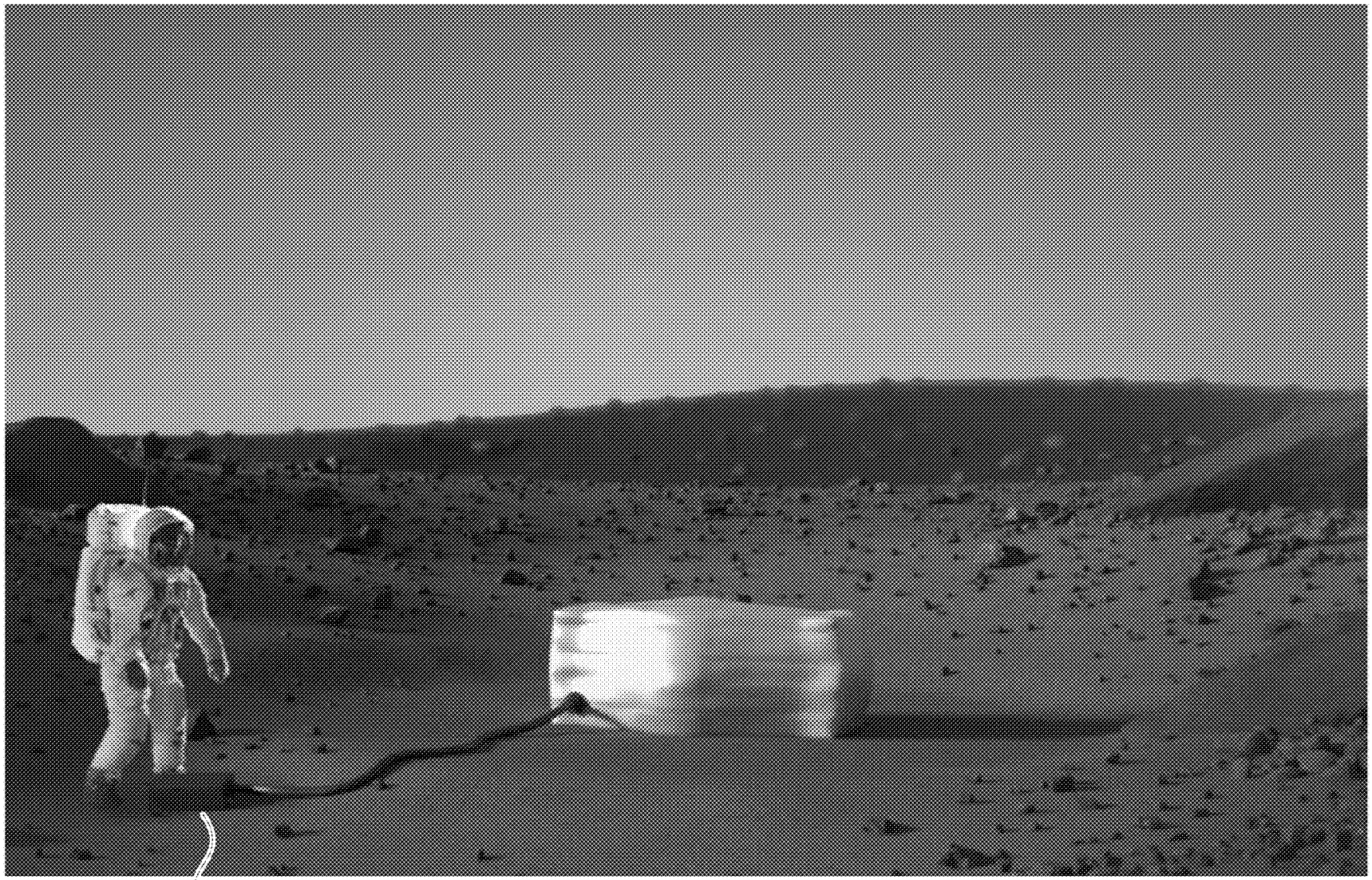
Figure 3C:
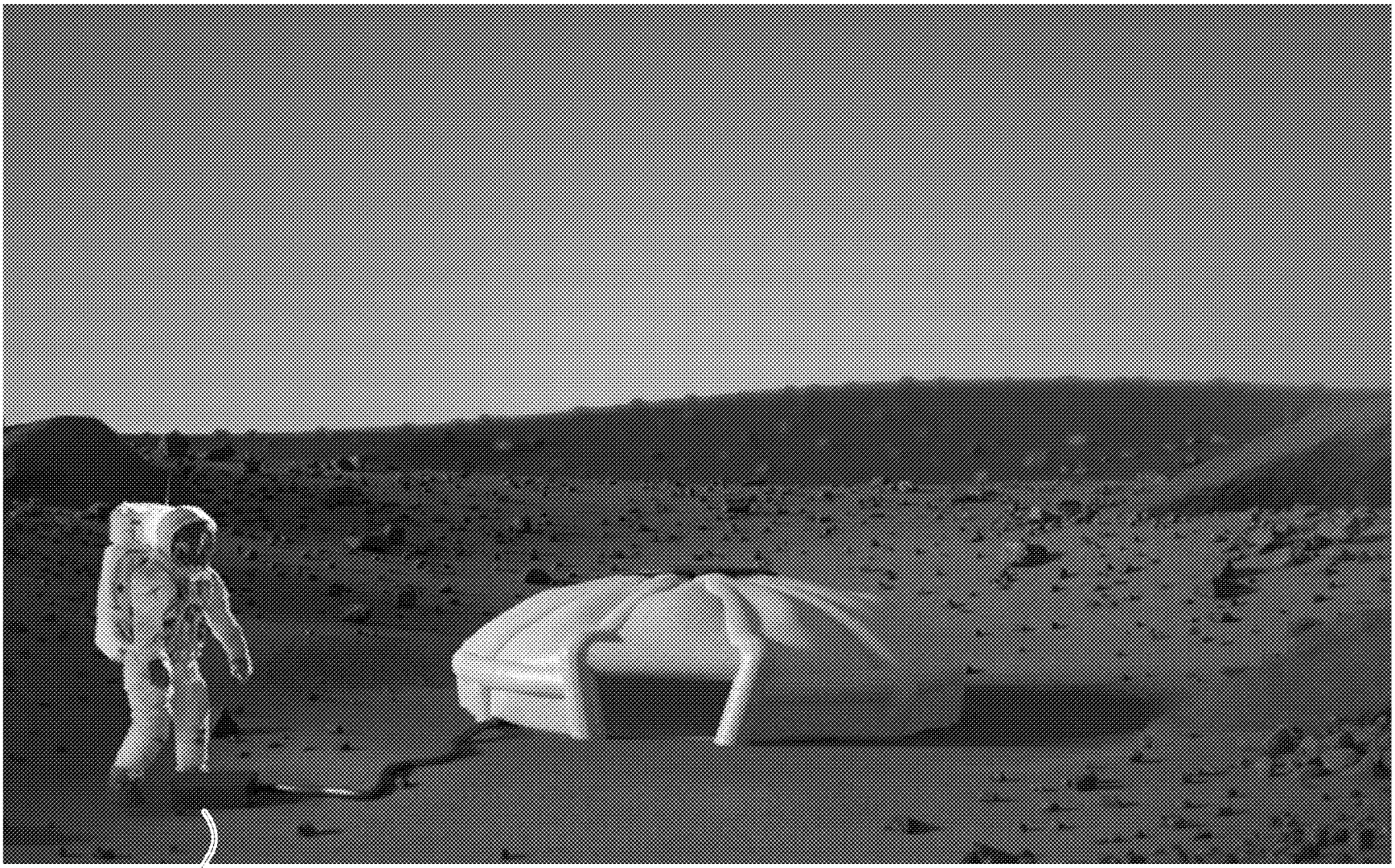
Figure 3D:
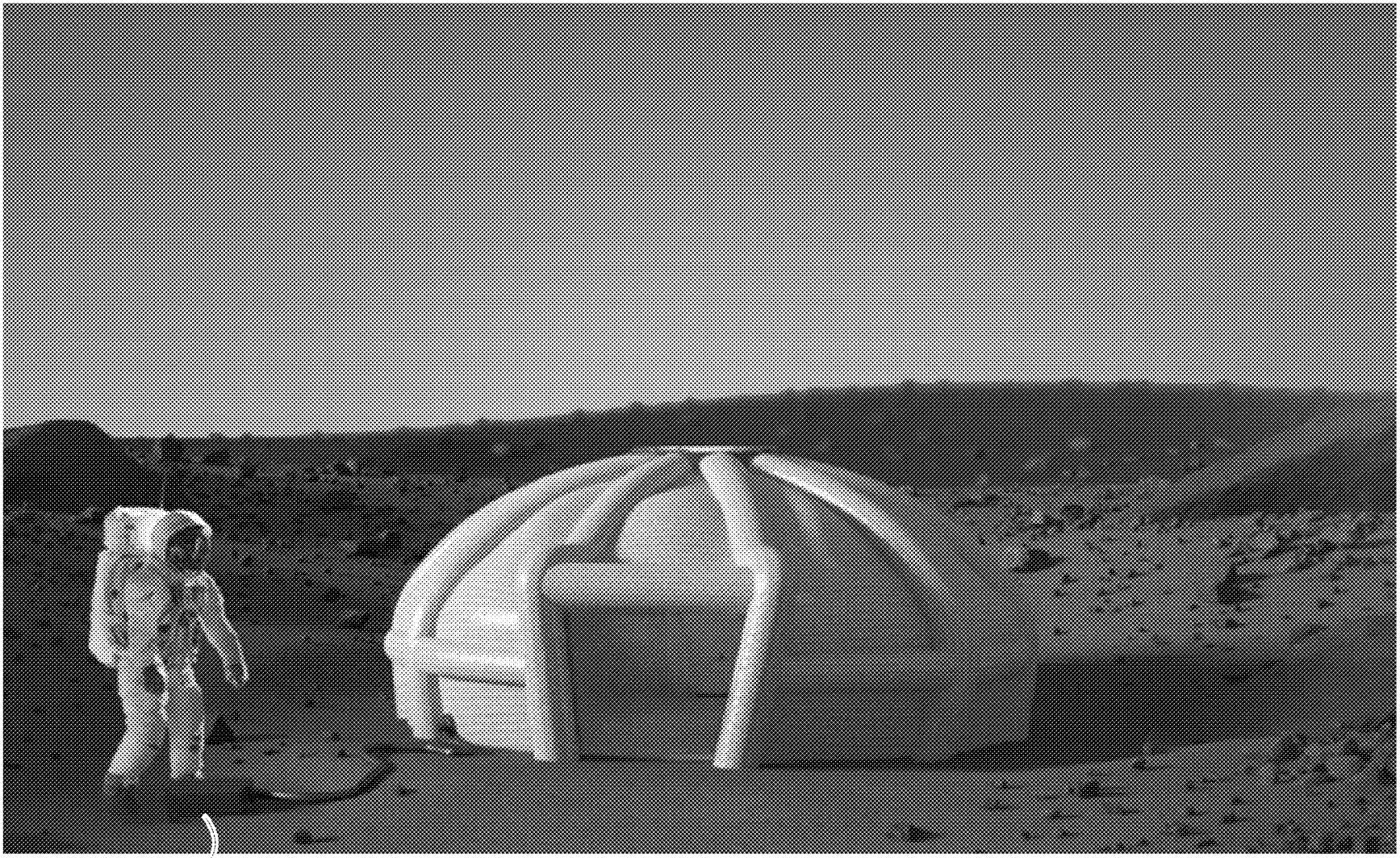
Figure 3E:
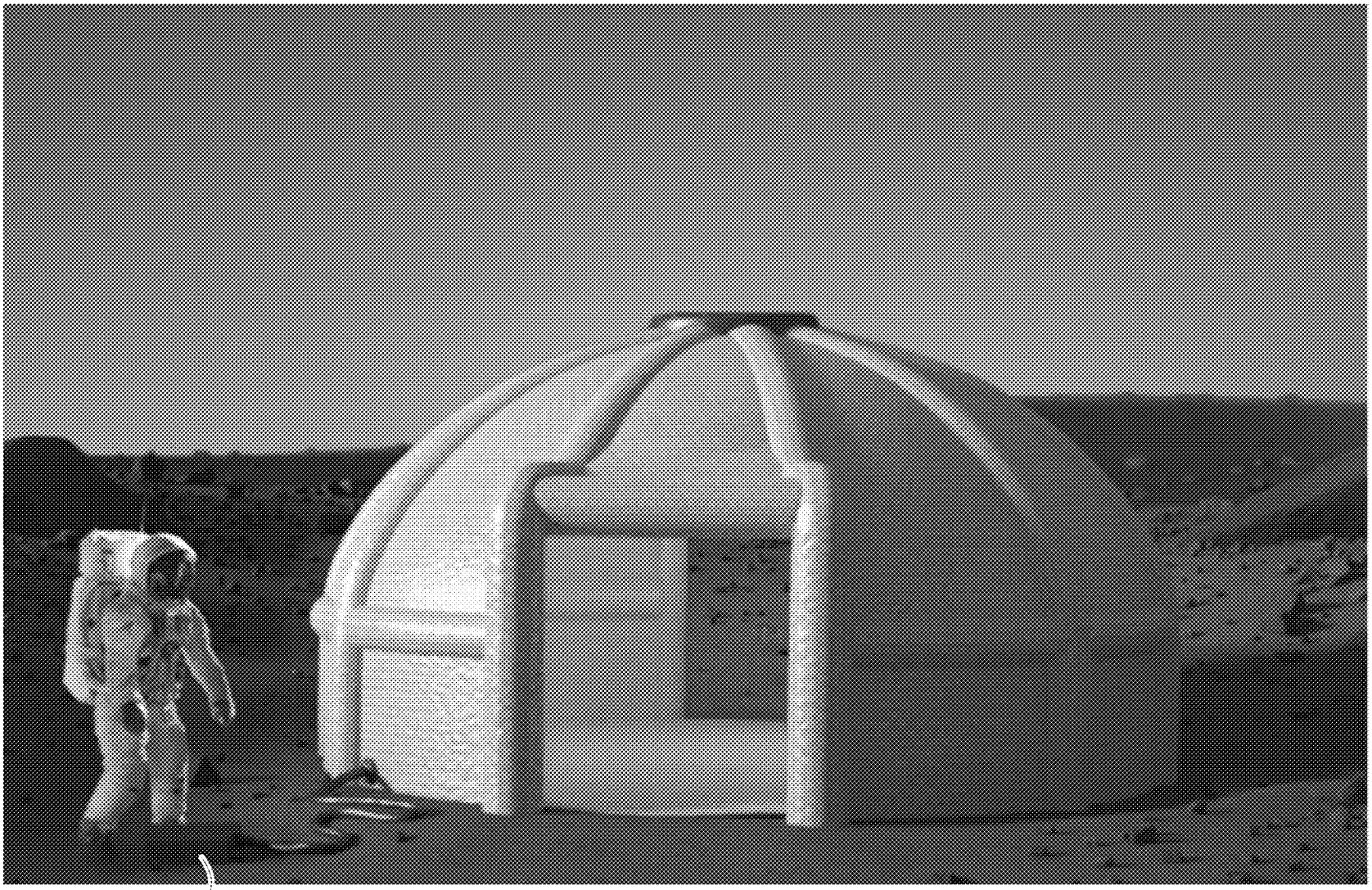
Figure 4:
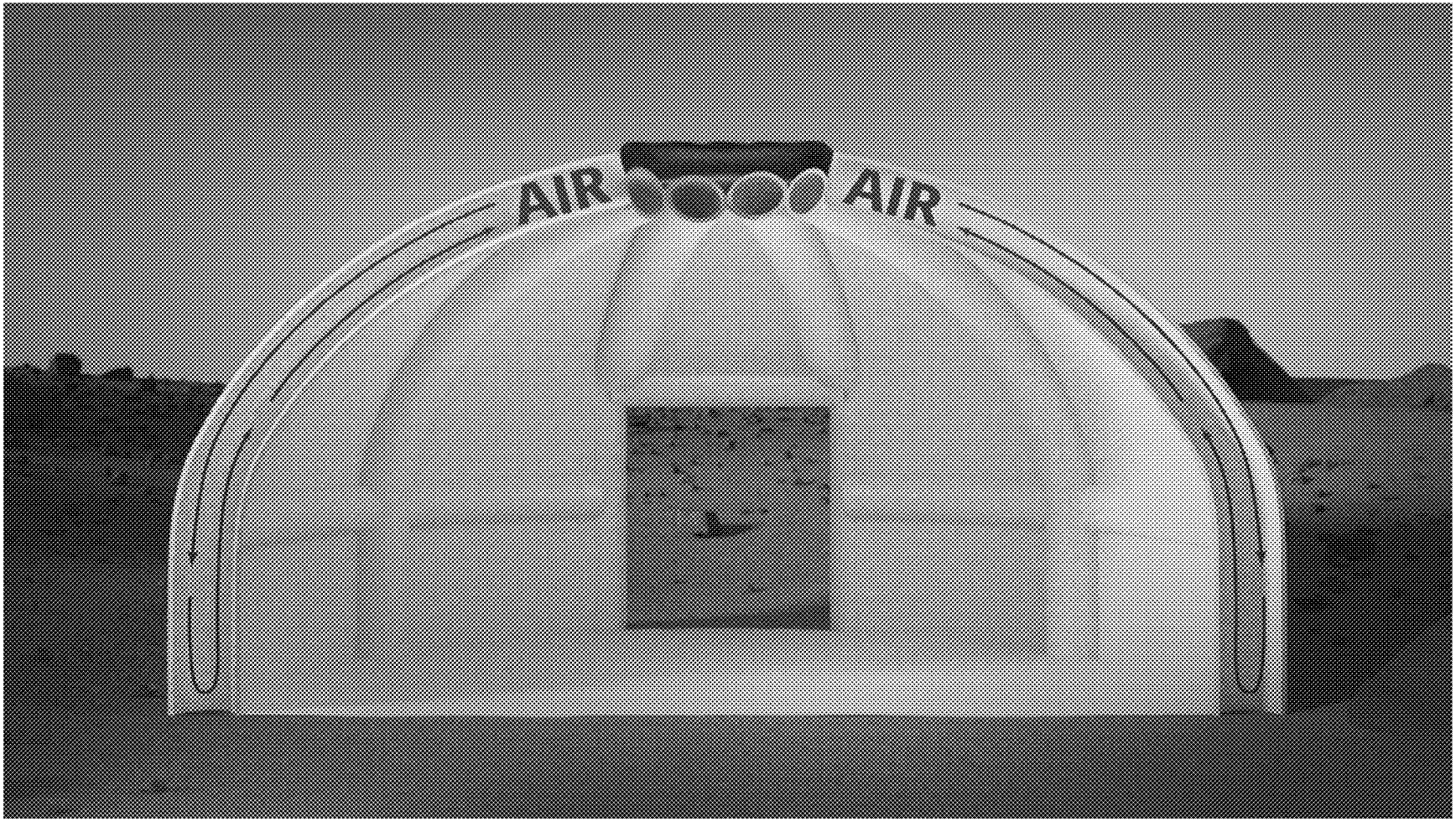
FIGS. 4 and 5 provide cross-sectional views of structures including one or more strut tubes according to an embodiment of the invention.
Figure 5:
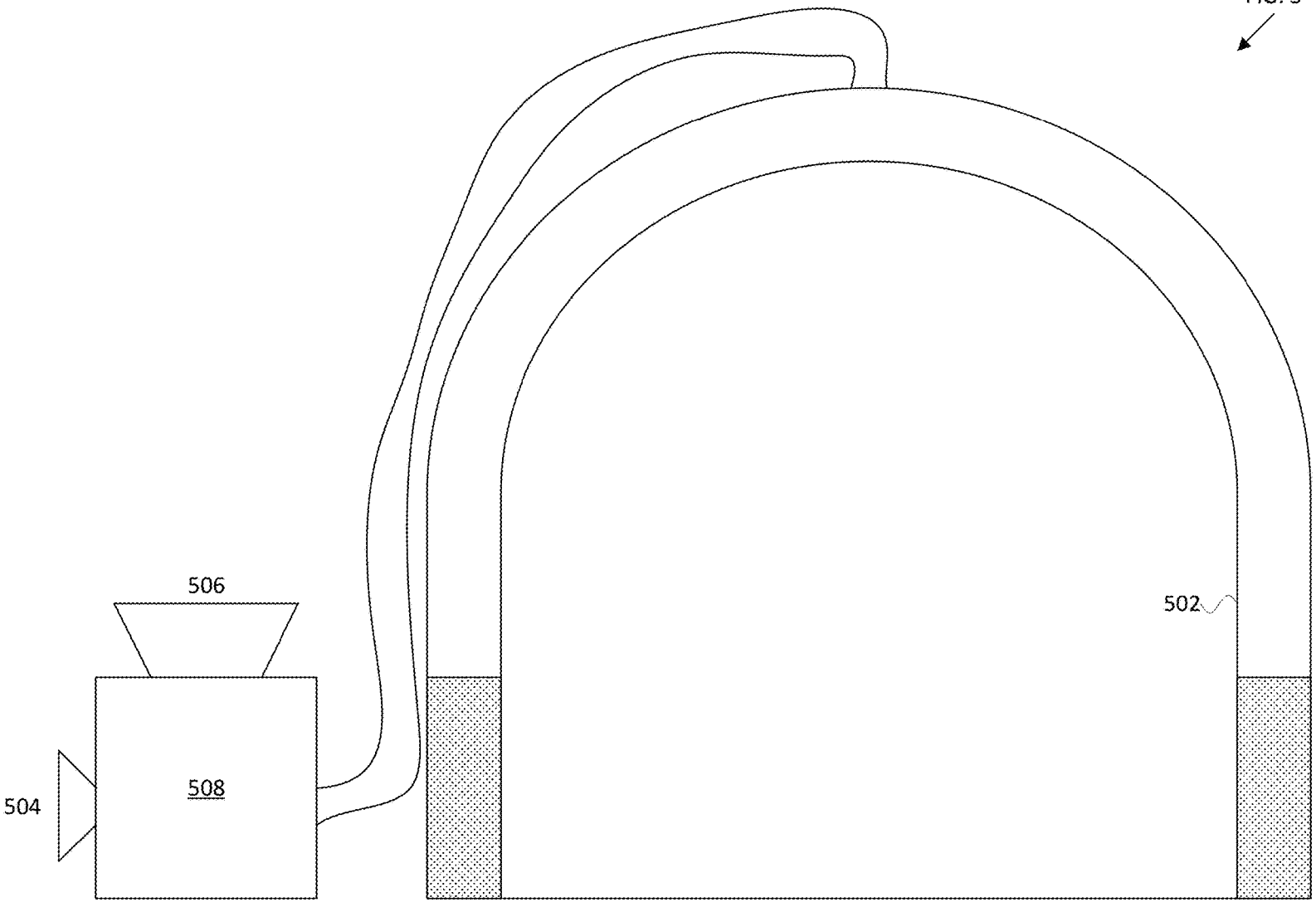

Referring now to FIGS. 3A-3E and 5, embodiments of the invention can be provided in a compact, uninflated form (FIG. 3A). Compacted structure can be provided in a crate, wrapping, or other container for handling during shipping. In some embodiments, the compacted structure can be palletized and/or air-dropped via parachute to a desired location (terrestrial or otherwise). A blower 508 can be detachably coupled to structure 500 and its struts 502. Blower 508 can be human-powered (e.g., through a hand crank and the like) or can be an electromechanical device powered by one or more photovoltaic elements, batteries, fuel cells, generators, and the like. Blower 508 can draw in air 504 before drawing in granular material 506. Blower 508 can include one or more grates or other devices for regulating the passage of granular material 506 from a hopper into the air stream, thereby promoting entrainment of the granular material 506 into the air stream.

On Mars, even before attachment of an airlock section, embodiments of the invention offer space-suited astronauts immediate protection from the elements, such as a sandstorm. This highlights one of present invention's main advantages over current inflatable designs: it does not rely on the internal air pressure for its structural integrity. A puncture or malfunctioning airlock will not result in deflation.

Additionally, embodiments of the invention can be used long-term on Mars without an airlock or life-support systems, e.g., to house supplies, vehicles or any other materials that do not require a life-supporting environment. This represents a significant energy savings because such an "open" habitat could be readily available yet would not continually require energy expenditures to maintain either its structural integrity or life-support.

Exemplary Granular Materials

A variety of granular materials can be utilized. In some embodiments, the granular materials have a polyhedral or irregular shape to better facilitate jamming.

Without being bound by theory, Applicant believes that embodiments of the invention can be utilized within any granular material found in situ at the erection site, thereby avoiding the need to deliver or obtain a particular granular material. Suitable granular materials include, but are not limited to: soil, sand, gravel, rock, ash, regolith, wood chips, garbage, fecal matter, and the like. The granular materials can be the result of milling, sifting, and/or other techniques for producing smaller and/or more uniform particles.

Synthetic granular materials such as polymers or plastics can also be utilized. In some embodiments, the granular materials can include hollow regions to facilitate a lower density.

In still another embodiment, the granular material can be a slurry or gel that transitions to a glass-like solid under pressure.

The granular material can have a variety of dimensions. In one embodiment, the mean or median cross-sectional dimension for granular material is between about 1 mm and about 10 mm, between about 1 mm and about 5 mm, between about 1 mm and about 3 mm, and the like.

Furniture and Military Apparatus Kits

Figure 6:
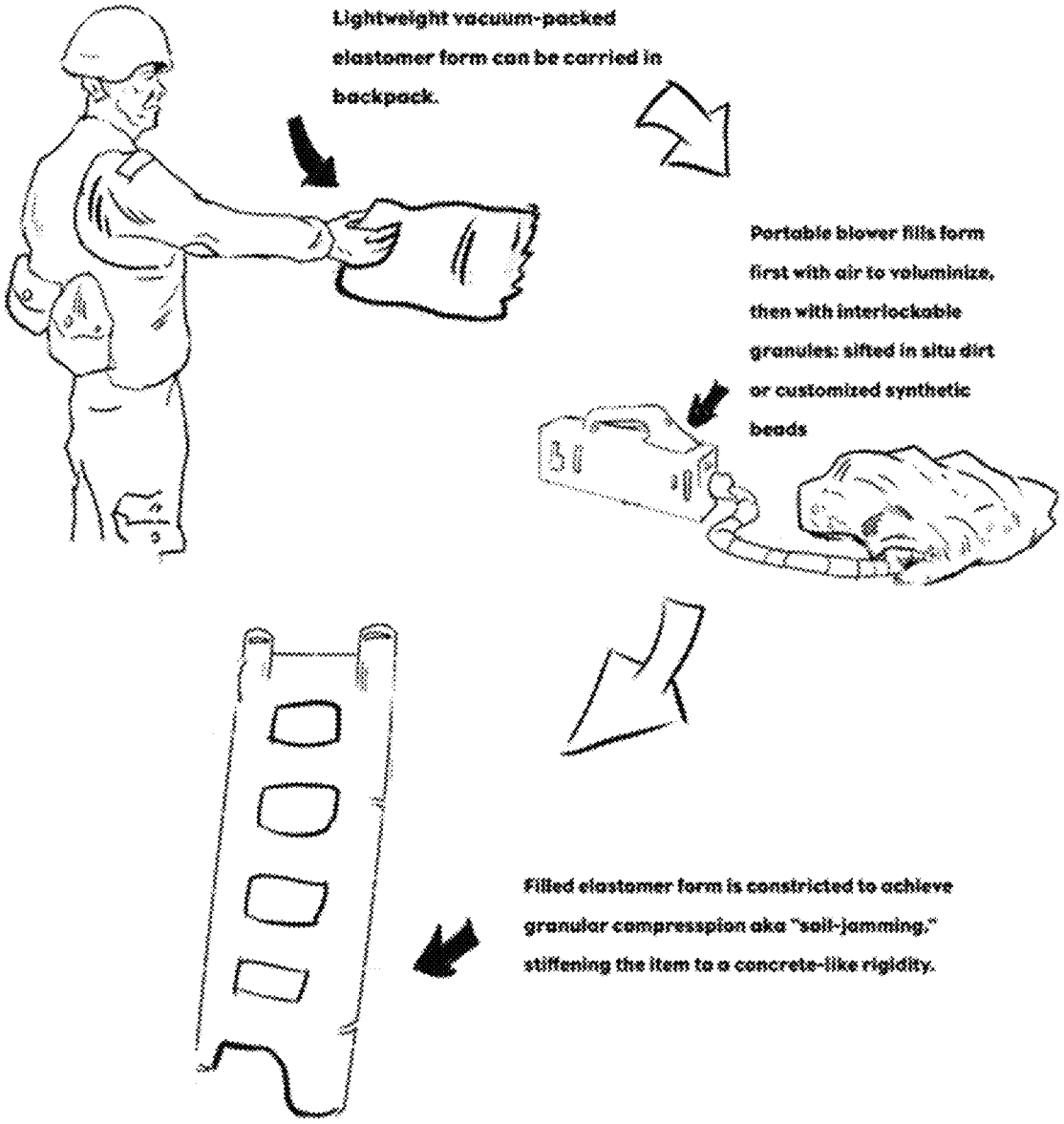
FIG. 6 depicts a method and system for preparing a ladder according to an embodiment of the invention.
Figure 7:
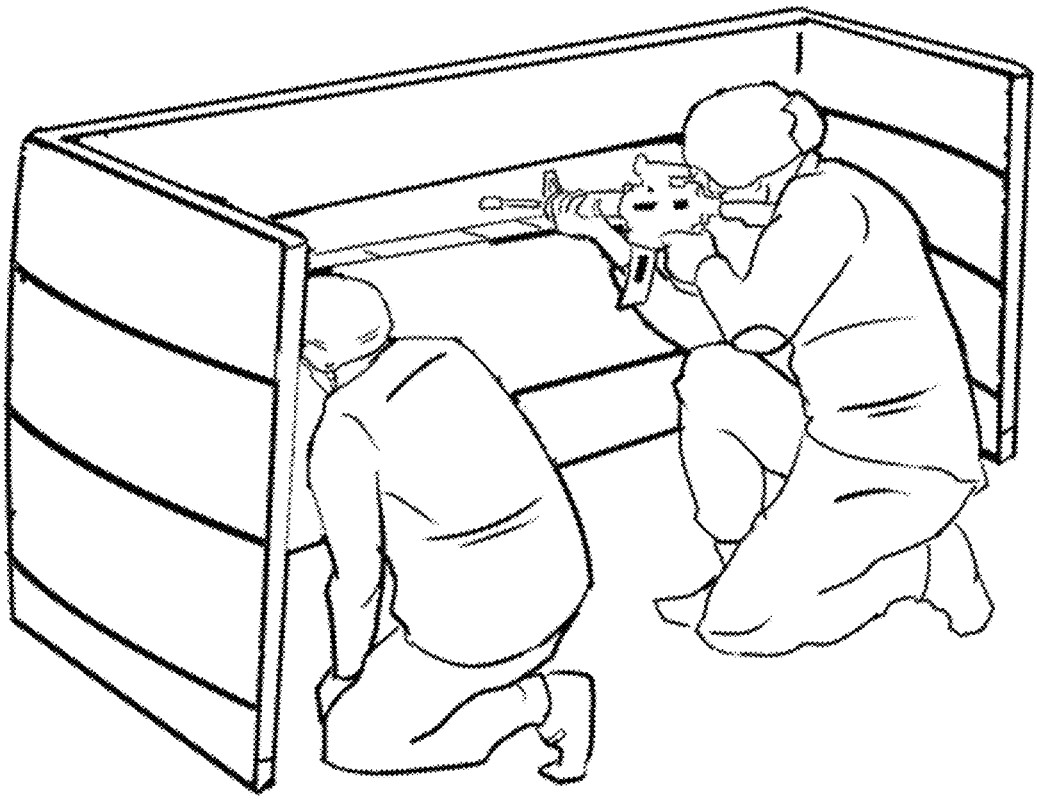
FIG. 7 depicts a field fortification according to an embodiment of the invention.
Figure 8:
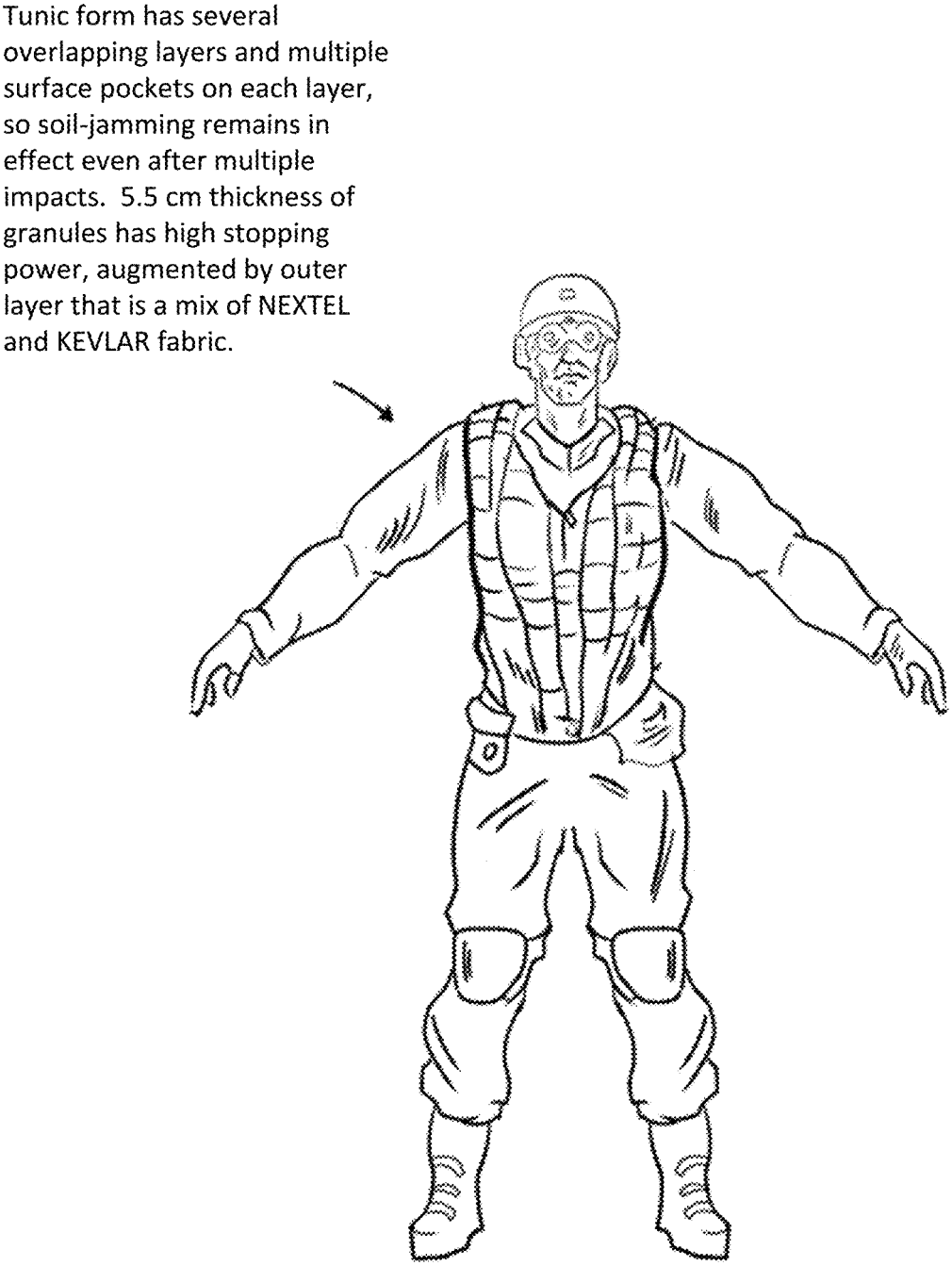
FIG. 8 depicts body armor according to an embodiment of the invention.
Figure 9:
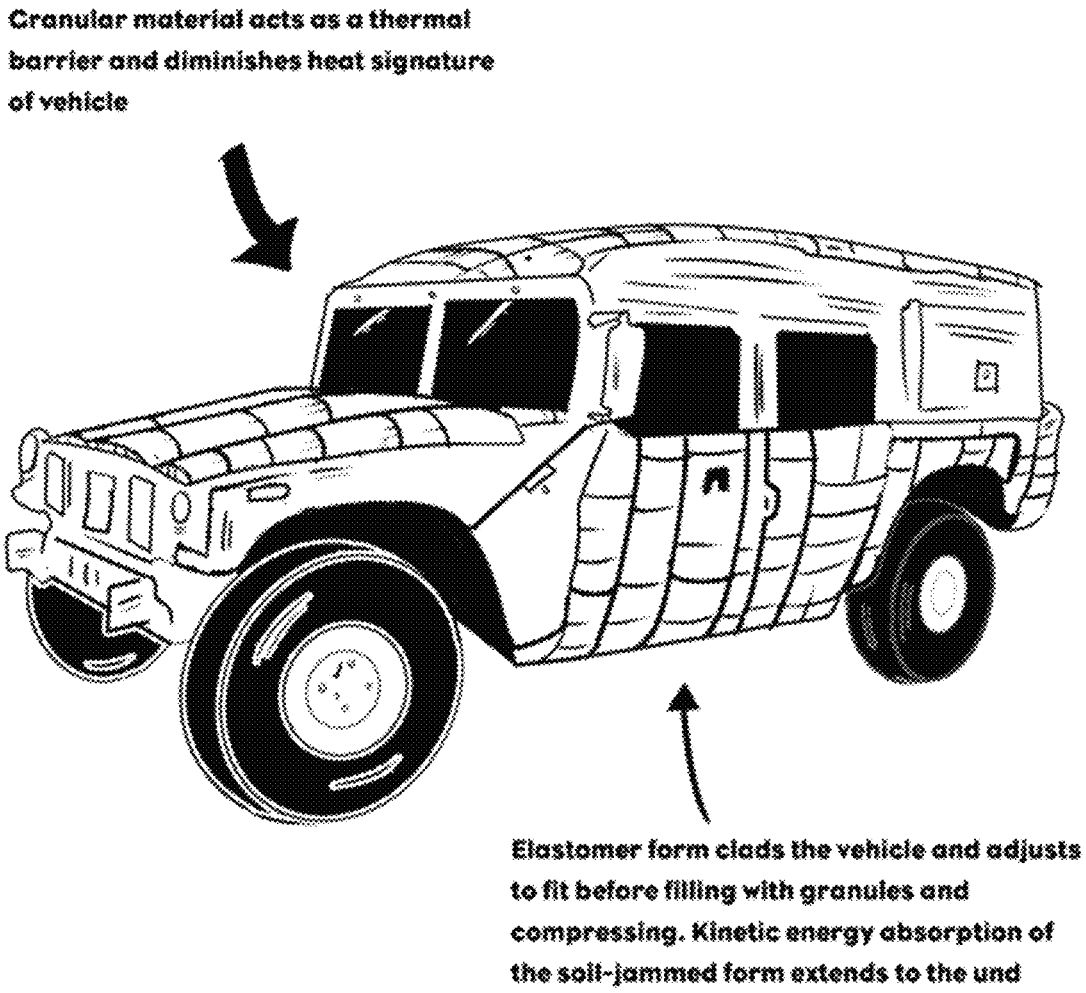
FIG. 9 depicts vehicle armor according to an embodiment of the invention.

Embodiments of the invention can also be applied to applications as diverse as furnishings and military apparatus (e.g., a ladder as depicted in FIG. 6, a field fortifications as depicted in FIG. 7, body armor as depicted in FIG. 8, and vehicle armor as depicted in FIG. 9). For example, flexible and collapsible shells can be designed to approximate a desired structure. Exemplary furnishings can include a chair, a chaise lounge, an ottoman, a footstool, a tuffet, a couch, a bench, a bed, a table, and the like. The shell can be sold separately from or in conjunction with granules. In some embodiments, the granules can be relatively low-density plastic pellets so that both the shell and the pellets can be easily transported to a dwelling (e.g., a dormitory or apartment) before filling with the granular materials and vacuum sealing.

Similarly, field fortifications (e.g., for soldiers or vehicles such as High Mobility Multipurpose Wheeled Vehicle (HMMWV)) can be provided as shells that can be filled with a variety of granular materials such as soil or sand. The shell can be engineered (e.g., through a combination of shell materials such as para-aramids and internal dimensions) to stop or slow a defined caliber projectile (e.g., bullet, mortar, shell, shrapnel, and the like) traveling at a defined velocity and/or resist or diffuse a defined blast force.

In either embodiment, the shell can include one or more ports adapted and configured to allow fluid (e.g., air) and granular material ingress and/or egress. For example, a shell can define a closed (e.g., airtight or substantially airtight) volume except for one or more filling inlets and vacuum outlets. During filling, a fluid stream can be introduced via the filling inlet. The fluid stream can be entrained with the granular material. After inflating the shell, air over a defined pressure can pass through a check valve and exit the shell. A screen between the interior of the shell and the check valve can retain the granular material within the shell. When filled with granular material, the filling inlet can be closed and a vacuum can be pulled across the check valve by the vacuum outlet. When the structure is no longer needed, vacuum can be broken (e.g., by removing the check valve or opening another vent) and the granular material can be removed (e.g., by suction) and reused or recycled.

In one embodiment, inflation and vacuum are provided by the same device. For example, many wet/dry vacuums include an exhaust port that can be utilized to inflate the shell. A tee fitting can be sized to interface with the filling inlet, a container (e.g., bag), and a wet/dry vacuum hose. In some embodiments, a vacuum/blower can be rented for use with the furniture.

EQUIVALENTS

Although preferred embodiments of the invention have been described using specific terms, such description is for illustrative purposes only, and it is to be understood that changes and variations may be made without departing from the spirit or scope of the following claims.

INCORPORATION BY REFERENCE

The entire contents of all patents, published patent applications, and other references cited herein are hereby expressly incorporated herein in their entireties by reference.

The invention claimed is:

1. A structure comprising:

one or more strut tubes; and granular material received and held within the one or more strut tubes, wherein the granular material is selected from the group consisting of: soil, sand, gravel, regolith, and plastic pellets;

wherein the one or more strut tubes further comprise compression means for applying at least compression to the granular material after loading of the granular material into the one or more strut tubes.

2. The structure of claim 1, further comprising:

one or more sheathing pieces integrated with, coupled to, or couplable to the one or more strut tubes.

3. The structure of claim 1, wherein the one or more strut tubes are flexible before loading.

4. The structure of claim 1, wherein the compression means are selected from the group consisting of: tensioners, fasteners, shape-memory members, piezoelectric members, cross-linkers, press fittings, and a pressure differential.

5. The structure of claim 1, wherein the one or more strut tubes are fabricated from a textile or flexible sheet.

6. The structure of claim 5, wherein the one or more strut tubes are fabricated from a high-tensile textile or flexible sheet.

7. The structure of claim 5, wherein the textile comprises one or more selected from the group consisting of: aramids, para-aramids, meta-aramids, and ceramic fibers.

8. The structure of claim 1, wherein:

the one or more strut tubes are substantially fluid-tight; and the compression means comprises:

a vacuum port;

a check valve fluid communication with the vacuum port; and a screen between the check valve and an interior region of the one or more strut tubes.

9. The structure of claim 1, wherein the compression causes the granular materials to jam and become rigid.

* * * * *